US008347765B2

(12) United States Patent
Chen

(10) Patent No.: US 8,347,765 B2
(45) Date of Patent: Jan. 8, 2013

(54) AXIAL CONNECTING STRUCTURE OF PLIERS

(76) Inventor: Jun Fan Chen, Taichung (TW)

( * ) Notice: Subject to any disclaimer, the term of this patent is extended or adjusted under 35 U.S.C. 154(b) by 151 days.

(21) Appl. No.: 13/009,072

(22) Filed: Jan. 19, 2011

(65) Prior Publication Data

US 2012/0180607 A1 Jul. 19, 2012

(51) Int. Cl.
*B25B 7/04* (2006.01)

(52) U.S. Cl. ..... 81/423; 81/386; 81/177.9; 81/177.7; 16/111

(58) Field of Classification Search ..... 81/418–426.5, 81/186, 427.5, 386–387, 177.8, 177.9; 30/194, 30/260, 266, 244; 433/3, 4; 269/257–284; 403/83–84, 91–96
See application file for complete search history.

(56) References Cited

U.S. PATENT DOCUMENTS 4,530,262 A * 7/1985 Pownall ..... 81/177.9
5,062,179 A * 11/1991 Huang ..... 16/436
2010/0050826 A1* 3/2010 Fan ..... 81/386

* cited by examiner

*Primary Examiner* — Monica Carter
*Assistant Examiner* — Melanie Alexander

(57) ABSTRACT

An axial connecting structure of pliers contains two symmetrical bodies axially connected together by using a first screw bolt and a nut; each body including a first extension with a grip and a second extension axially connected with a clamping paw, wherein the second extension includes a hollow fitting member, the fitting member includes a central hole, a limiting shaft, a positioning orifice to receive a spring and a ball, and a circular disc; the clamping paw includes an annular tab having a central post, the post includes an axial aperture, the tab also includes a receiving chamber to fit the fitting member and an inner fringe, the receiving chamber includes a guiding groove based on a radian of a predetermined degree of first central angle, the inner fringe includes plural recesses arranged thereon based on a radian of a second central angle.

5 Claims, 4 Drawing Sheets

AXIAL CONNECTING STRUCTURE OF PLIERS

BACKGROUND OF THE INVENTION

1. Field of the Invention

The present invention relates to an axial connecting structure of pliers.

2. Description of the Prior Art

A conventional axial connecting structure of pliers disclosed in U.S. Pat. Nos. 6,389,937, 6,220,126, 5,255,579, 1,445,908, 2,779,224 and 2,815,777 contains two symmetrical bodies axially connected together by using a screw bolt and a nut; each body includes a first extension formed on a rear end thereof and having a grip to be held by a user, a second extension disposed on a front end thereof and axially connected with a clamping paw, such that the grip is operated to actuate the clamping paw of the second extension to clamp a workpiece. However, the axial connecting structure of pliers can not position the body and the clamping paw securely to cause an unstable operation.

Another conventional axial connecting structure of pliers disclosed in U.S. Pat. No. 7,156,004 contains a ratchet member, a ball, and a spring fixed on a clamping paw so that the ball and the spring axially push the ratchet member to axially position a body and a clamping paw. Nevertheless, the ratchet member is not provided with a guiding member, so two bodies have to be rotated to achieve a symmetrical angle, operating the pliers with time and force consumption. In addition, the ratchet member of the body is exposed outside to clamp the user's fingers easily.

The present invention has arisen to mitigate and/or obviate the afore-described disadvantages.

SUMMARY OF THE INVENTION

The primary object of the present invention is to provide an axial connecting structure of pliers that is capable of obtaining a safe operation and a stable support.

The present invention is to provide an axial connecting structure of pliers contains:

two symmetrical bodies axially connected together by using a first screw bolt and a nut; each body including a first extension formed on a rear end thereof and having a grip to be held by a user, a second extension disposed on a front end thereof and axially connected with a clamping paw, such that the grip is operated to actuate the clamping paw of the second extension to clamp a workpiece, characterized in that:

the second extension of the body includes a hollow fitting member extending outward from a head end thereof, the fitting member includes a central hole and includes a limiting shaft extending outward from one end thereof and includes a positioning orifice fixed on an outer peripheral wall thereof to receive a spring and a ball and includes a circular disc secured on another end thereof;

the clamping paw includes an annular tab disposed on one end thereof, and the tab includes a central post extending outward therefrom, and the post includes an axial aperture fixed therein and is axially inserted into the hole of the fitting member, the tab also includes a receiving chamber disposed therein to fit the fitting member and an inner fringe formed therearound, the receiving chamber includes a guiding groove formed on a bottom end thereof based on a radian of a predetermined degree of first central angle, the inner fringe includes a plurality of recesses arranged thereon based on a radian of a second central angle which equals to a round angle decreasing the first central angle so that the spring and the ball are retained in one of the recesses to position the clamping paw and the body.

DETAILED DESCRIPTION OF THE PREFERRED EMBODIMENTS

Figure 1:
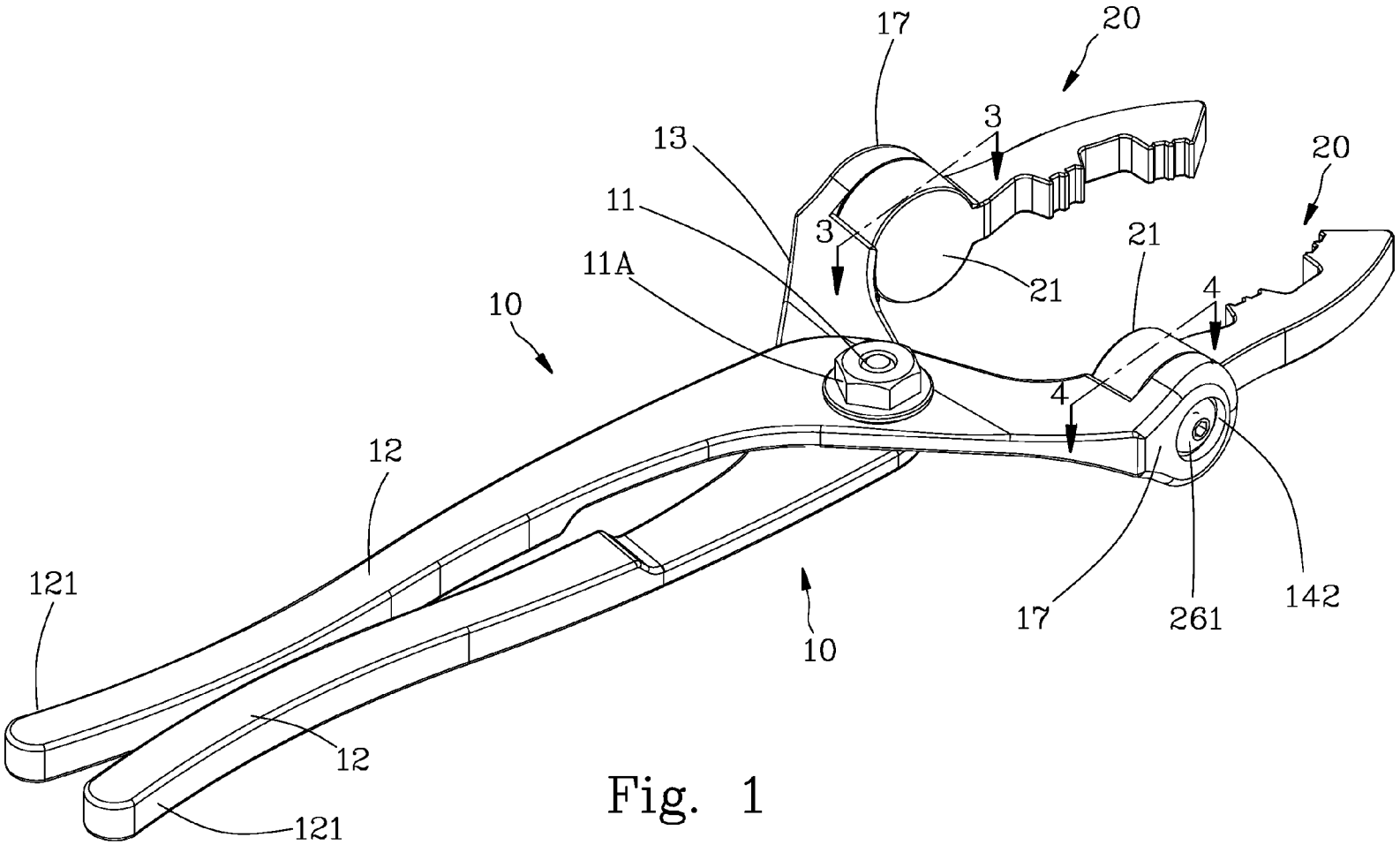
FIG. 1 is a perspective view showing the assembly of an axial connecting structure of pliers in accordance with the present invention.

The present invention will be clearer from the following description when viewed together with the accompanying drawings, which show, for purpose of illustrations only, the preferred embodiment in accordance with the present invention.

Referring to FIGS. 1-4, an axial connecting structure of pliers in accordance with the present invention comprises two symmetrical bodies 10 axially connected together by using a first screw bolt 11 and a nut 11A; each body 10 includes a first extension 12 formed on a rear end thereof and having a grip 121 to be held by a user, a second extension 13 disposed on a front end thereof and axially connected with a clamping paw 20, such that the grip 121 is operated to actuate the clamping paw 20 of the second extension 13 to clamp a workpiece.

Figure 2:
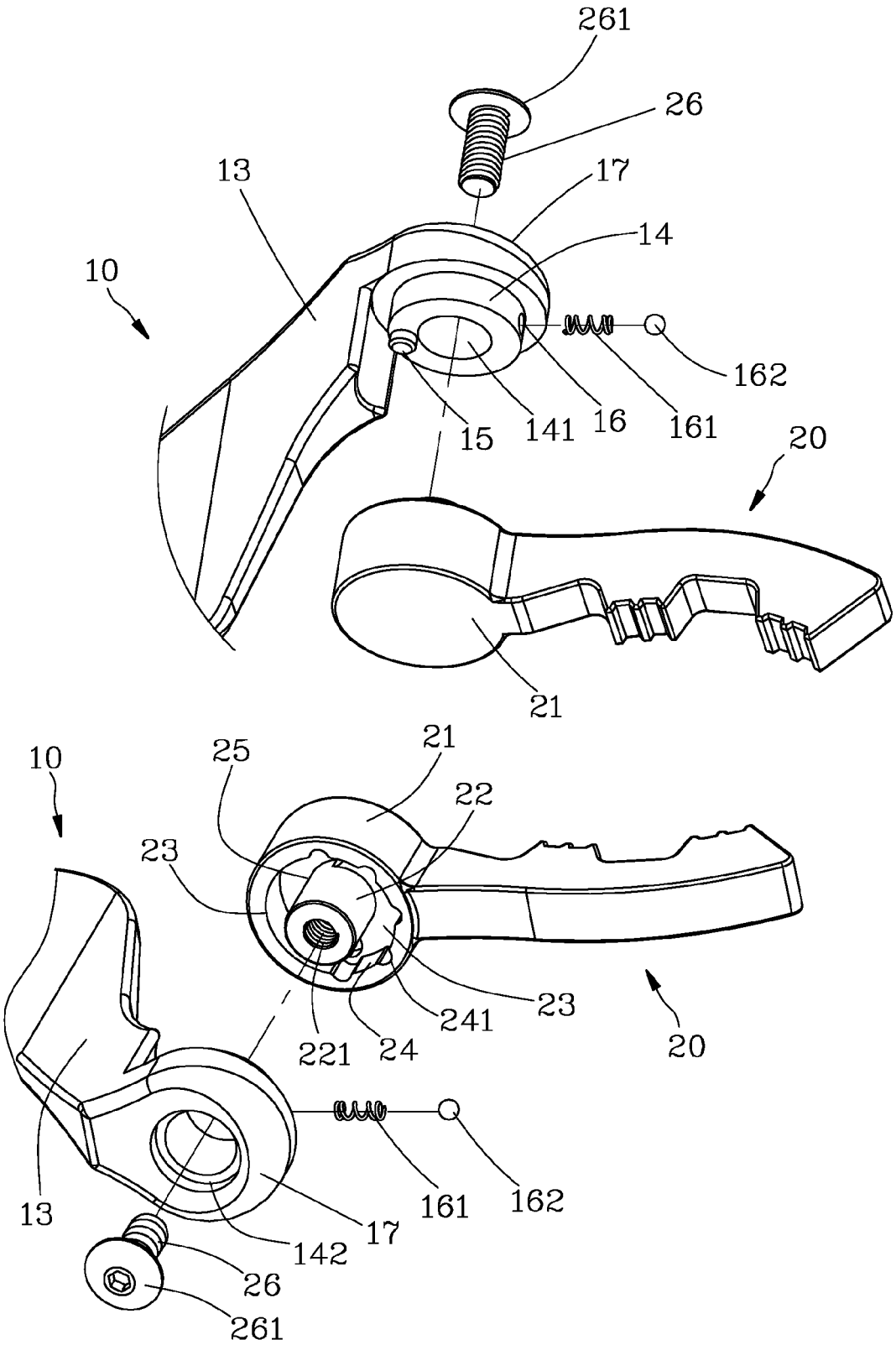
FIG. 2 is a perspective view showing a part of the exploded components of an axial connecting structure of pliers in accordance with the present invention.

As showing a FIG. 2, the second extension 13 of the body 10 includes a hollow fitting member 14 extending outward from a head end thereof, the fitting member 14 includes a central hole 141 having an annular shoulder 142 arranged in the hole 141 and includes a limiting shaft 15 extending outward from one end thereof and includes a positioning orifice 16 fixed on an outer peripheral wall thereof to receive a spring 162 and a ball 162 and includes a circular disc 17 secured on another end thereof to close the receiving chamber 23.

Figure 3:
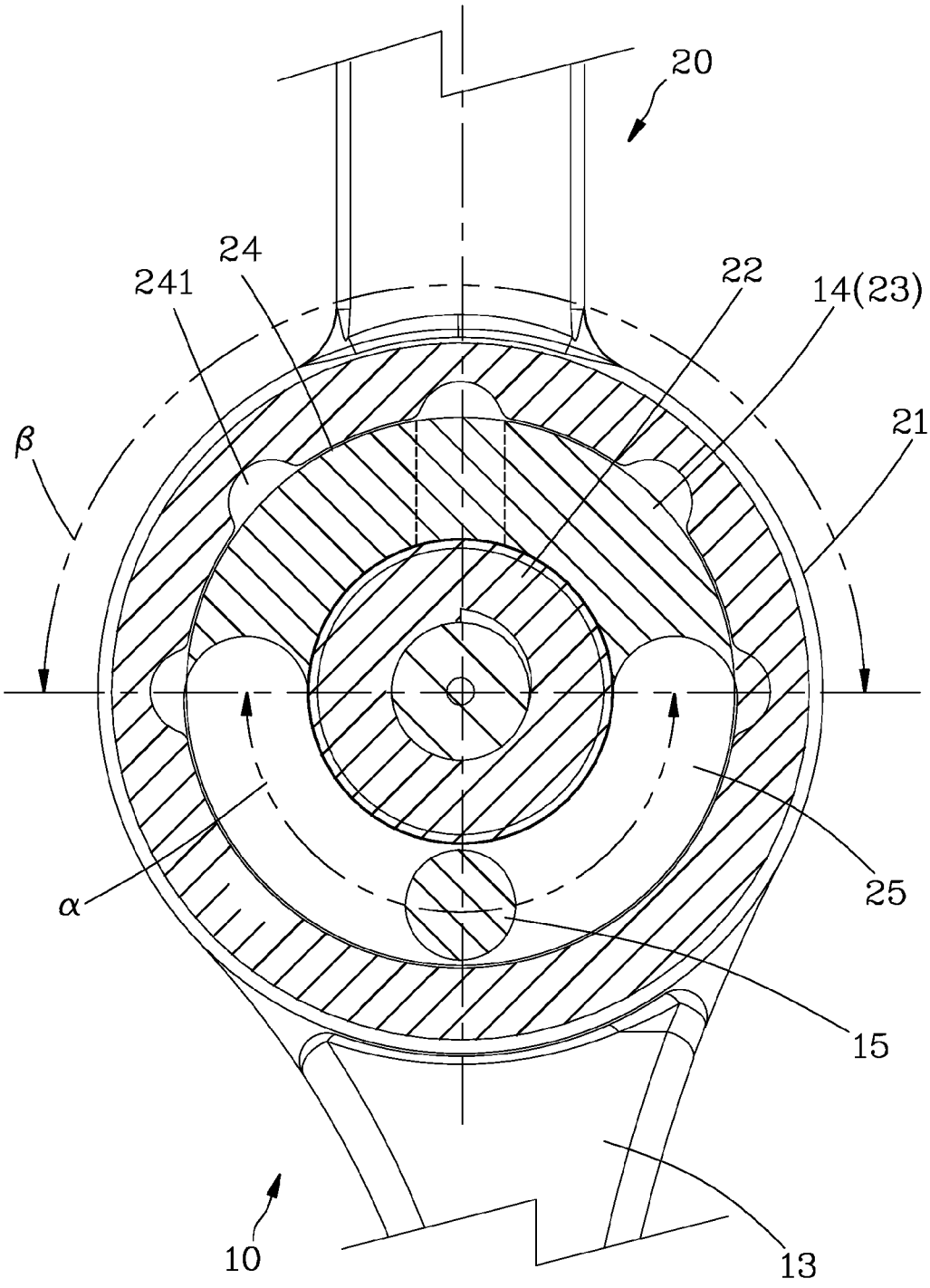
FIG. 3 is a cross sectional view taken along the line 3-3 of FIG. 1.
Figure 4:
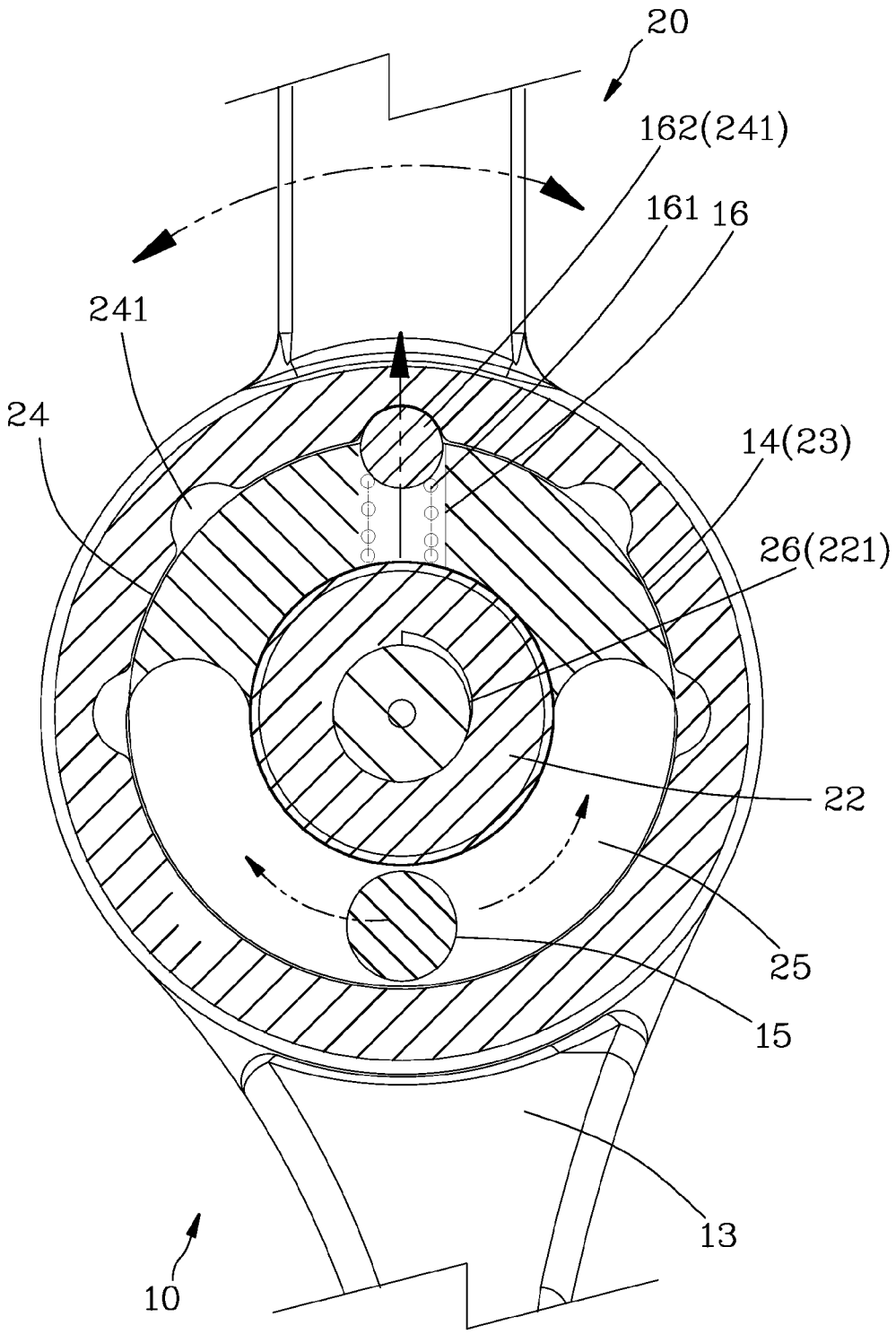
FIG. 4 is a cross sectional view taken along the line 4-4 of FIG. 1.

As illustrated in FIG. 2, the clamping paw 20 includes an annular tab 21 disposed on one end thereof, and the tab 21 includes a central post 22 extending outward therefrom, and the post 22 includes an axial aperture 221 fixed therein to match with a second screw bolt 26 to limit the shoulder 142 and is axially inserted into the hole 141 of the fitting member 14, the tab 21 also includes a receiving chamber 23 disposed therein to fit the fitting member 14 and an inner fringe 24 formed therearound. Referring to FIG. 3, the receiving chamber 23 includes a guiding groove 25 formed on a bottom end thereof based on a radian of a 180 degree of first central angle $\alpha$, the inner fringe 24 includes a plurality of recesses 241 arranged thereon based on a radian of a second central angle $\beta$ which equals to a 360 degree of round angle decreasing the first central angle $\alpha$. With reference to FIG. 4, the spring 161 and the ball 162 are retained in one of the recesses 241 to position the clamping paw 20 and the body 10.

In assembly, the fitting member 14 of the body 10 is fitted into the receiving chamber 23 of the clamping paw 20, and then the post 22 of the clamping paw 20 is inserted into the hole 141 of the fitting member 14 so that the body 10 is connected with the clamping paw 20, thereafter the second screw bolt 26 is screwed with the aperture 221 of the post 22 so that a circular projection 261 of the second screw bolt 26 limits the shoulder 142, hence the axial connecting structure of the body 10 and the clamping paw 20 of the pliers will not clamp a user when the body 10 and the clamping paw 20 rotate by ways of the larger-diameter disc 17 and a close end of the tab 21, obtaining a safety purpose.

Referring to FIGS. 3 and 4, in operation, the clamping paw 20 and the body 10 is axially coupled together so that the post 22 of the clamping par member 20 is axially rotated and forced in the hole 141 of the fitting member 14, and the fitting member 14 of the body 10 contacts with and axially rotates in the receiving chamber 23 of the clamping paw 20, the spring 161 of the positioning orifice 16 pushes the balls 162 to be retained in the recess 241 of the inner fringe 24, thus positioning the clamping paw 20 and the body 10. Furthermore, the first central angle $\alpha$ and the second central angle $\beta$ are used to make the recess 241 which retains with the limiting shaft 15 and the limiting shaft 15 are aligned with each other on the same straight line, and the guiding groove 25 and the limiting shaft 15 are applied to guide the spring 161 and the ball 162 to be further retained in the recess 241 of the inner fringe 24, such that the clamping paws 20 are adjusted quickly to move toward a predetermined position, obtaining a safe operation and a stable support.

While we have shown and described various embodiments in accordance with the present invention, it is clear to those skilled in the art that further embodiments may be made without departing from the scope of the present invention.

What is claimed is:

1. An axial connecting structure of pliers comprising:

two symmetrical bodies axially connected together by using a first screw bolt and a nut; each body including a first extension formed on a rear end thereof and having a grip to be held by a user, a second extension disposed on a front end thereof and axially connected with a clamping paw, such that the grip is operated to actuate the clamping paw of the second extension to clamp a workpiece, characterized in that:

the second extension of the body includes a hollow fitting member extending outward from a head end thereof, the fitting member includes a central hole and includes a limiting shaft extending outward from one end thereof and includes a positioning orifice fixed on an outer peripheral wall thereof to receive a spring and a ball and includes a circular disc secured on another end thereof;

the clamping paw includes an annular tab disposed on one end thereof, and the tab includes a central post extending outward therefrom, and the post includes an axial aperture fixed therein and is axially inserted into the hole of the fitting member, the tab also includes a receiving chamber disposed therein to fit the fitting member and an inner fringe formed therearound, the receiving chamber includes a guiding groove formed on a bottom end thereof based on a radian of a predetermined degree of first central angle, the inner fringe includes a plurality of recesses arranged thereon based on a radian of a second central angle which equals to a round angle decreasing the first central angle so that the spring and the ball are retained in one of the recesses to position the clamping paw and the body.

2. The axial connecting structure of the pliers as claimed in claim 1, wherein the hole of the fitting member has an annular shoulder arranged therein, and the post includes an axial aperture fixed therein to match with a second screw bolt to limit the shoulder.

3. The axial connecting structure of the pliers as claimed in claim 1, wherein the fitting member includes a circular disc secured on another end thereof to close the receiving chamber.

4. The axial connecting structure of the pliers as claimed in claim 1, wherein a radian of the first central angle is 180 degrees.

5. The axial connecting structure of the pliers as claimed in claim 1, wherein a radian of the second central angle is 180 degrees.

* * * * *